US006265043B1

(12) United States Patent
Vinyard et al.

(10) Patent No.: US 6,265,043 B1
(45) Date of Patent: Jul. 24, 2001

(54) ERASABLE AND RE-WRITABLE DISC LABEL SYSTEM FOR OPTICAL DISCS

(75) Inventors: Jeffery Vinyard, San Jose; Michael L. Hummell, Newport Beach, both of CA (US)

(73) Assignee: Avery Dennison, Pasadena, CA (US)

( * ) Notice: Subject to any disclaimer, the term of this patent is extended or adjusted under 35 U.S.C. 154(b) by 0 days.

(21) Appl. No.: 09/313,904

(22) Filed: May 18, 1999

(51) Int. Cl.[7] ..... G09F 3/00

(52) U.S. Cl. ..... 428/40.1; 283/81; 428/40.2; 428/41.3; 428/41.5; 428/41.7; 428/41.8; 428/42.1; 428/43; 428/64.1; 428/66.5

(58) Field of Search ..... 428/40.1, 40.2, 428/41.5, 41.3, 41.7, 41.8, 42.1, 43, 64.1, 66.5; 283/81

(56) References Cited

U.S. PATENT DOCUMENTS 4,385,460 5/1983 Hanna ..... 40/340
4,983,437 * 1/1991 Merrick ..... 428/40.1
5,040,296 * 8/1991 Yerger ..... 40/299

* cited by examiner

*Primary Examiner*—Nasser Ahmad
(74) *Attorney, Agent, or Firm*—Walter A. Hackler

(57) ABSTRACT

An erasable and re-writable disc label system includes a release layer and a plastic film disposed over the release layer with one side of the plastic film releasably adhered to the release layer with an acrylic adhesive for enabling permanent application of the plastic film to an optical disc without degradation of disc optic properties. The plastic film is formed from material enabling the plastic film and adhesive to be removed from the release layer while maintaining plastic film initial shape, size and symmetry in order to prevent imbalancing of the optical disc upon application thereto. A coating is provided on a second side of the plastic film for enabling non-indelible marking thereon with a marker pen and subsequent erasure of the marking.

20 Claims, 1 Drawing Sheet

ERASABLE AND RE-WRITABLE DISC LABEL SYSTEM FOR OPTICAL DISCS

The present invention generally relates to labels and is more specifically directed to an erasable and re-writable disc label system for optical discs.

Optical discs, for example, CDs and DVDs, are a widespread media for data storage of all types including both music and software. Development of this media has provided for mass merchandising of recorded data, particularly music CDs. Advances in technology have now enabled individuals to record data on optical discs. This capability in turn has caused the development of applicators and labels for such optical discs.

These labels, which may be designed and printed by a personal computer, provide not only indicia regarding the contents of an optical disc to which the label is applied but also provide decoration therefor.

Still more recently, re-writable optical discs and equipment for recording on such discs has become economically feasible for individuals. Unfortunately, commonly used labels are limited to print once ability, i.e., writing or printing on the labels is indelible. It should be obvious that such a print-once label is not compatible with a re-writable optical disc medium.

That is, because the disc can be rewritten, there is a need to change the indicia on the label accordingly to properly identify the contents of the recorded data or to redecorate the optical disc.

An obvious solution is to reapply another label, or label segments, to an optical disc on which the recorded medium has been changed. This solution, however, is not practical inasmuch as optical discs are operated at a high rotating speed and balance thereof is extremely important in order to ensure accurate writing and reading of data therefrom.

If a paper label is utilized, repeated pencil marking and erasures are subject to smudging and continued erasures causes abrading of the paper surface, which is not attractive.

Even the repeated use of correction fluid such as, for example, Liquid Paper®, may cause imbalance of the optical disc. Further, the repeated use and rewriting utilizing correction fluid is not an attractive alternative.

Accordingly, there is a need for an erasable re-writable disc label system for optical discs which will provide the capability of correlating changes in the recorded medium on the label without interfering with performance of the optical disc.

SUMMARY OF THE INVENTION

An erasable and re-writable disc label system for optical discs in accordance with the present invention includes a plastic film having an acrylic adhesive means disposed on one side thereof for enabling permanent application of the plastic film to an optical disc without degradation of disc optical properties. Acrylic adhesive is utilized in order to prevent any possible interaction with the optical discs which may cause deterioration thereof.

The plastic film is formed from material enabling the plastic film and adhesive to be applied to the optical disc while maintaining the plastic film in shape, size and symmetry. This is important in order to prevent imbalancing of the optical disc upon application of the plastic film thereto.

Importantly, a coating disposed on a second side of the plastic film is provided for enabling non-indelible marking thereon with a marker pen and subsequent erasure of the marking. This feature provides compatibility with re-writable optical discs that heretofore was not available.

Preferably a release layer is provided for handling of the disc label prior to application to an optical disc. Accordingly, the plastic film is disposed over the release layer with one side of the plastic film releasably adhered thereto to the release layer with the acrylic adhesive. Structural integrity of the plastic film is very important since the film must be removed from the release layer while maintaining the plastic film initial shape, size and symmetry in order to prevent imbalancing of the optical disc upon application thereto as hereinabove noted. One suitable plastic film is a polyester.

An alternative embodiment of the present invention provides a label system wherein the plastic film and adhesive are transparent for enabling visual perception thee through of an existing label on an optical disc upon application of the plastic film and adhesive means thereonto. This embodiment finds use in effectively making an existing label and erase and re-writable label.

Yet another embodiment in accordance with the present invention provides for printing indelible indicia on the one side of the plastic film before application of the adhesive thereto. Utilization of the transparent plastic film then enables visual perception therethrough of indicia.

A coating on the second side of the plastic film enables non-indelible marking thereof with a marker pen and subsequent erasure of the marking. Thus, this label system provides for a permanent visual design on the label while at the same time enabling marking and an erasure at any point on the label. On the other hand, if the coating means is disposed only in selected areas on the plastic film second side in accordance with the present invention, only those selected areas will be capable of being marked and erased.

Still another embodiment of the present invention includes a plastic film including perforation means therein for defining selected separable areas of the plastic film with one side of the selected areas being releasably adhered to the release layer with acrylic adhesive. Coating means disposed on the second side of the plastic film selected areas enables non-indelible marking thereof with a marker pen and subsequent erasure of the marking.

In use, when the label is removed from the release layer and applied to an optical disc, the non-selected areas can be removed because of the perforations which define the selected areas. This enables symmetrical placement of the erasable and re-writable label areas onto an optical disc.

As a result, the background or design, an already labeled optical disc can be utilized with only certain selected portions, as defined by the selected areas of the label system, providing areas for marking and erasure.

In yet another embodiment of the present invention, an imprinted label may be utilized and disposed over the release layer by means of acrylic adhesive and a plastic film having one side adhered to another side of the imprinted layer. In this instance, the plastic film is transparent for enabling visual perception therethrough of the imprinted label. A coating is provided and disposed on the second side of the plastic film for enabling non-indelible marking thereon with a marker pen and subsequent erasure of the marker. This embodiment enables the use of a still inner plastic film.

Alternatively, an unprinted substrate label may be utilized and in this embodiment the plastic film includes indelible indicia on one side of the plastic film facing the substrate label. In this embodiment, the plastic film is preferably transparent for enabling visual perception of the indicia through the film itself. Further combinations of printing on the substrate and on the plastic film may be used to create differing visual effects.

BRIEF DESCRIPTION OF THE DRAWINGS

The present invention may be more clearly appreciated when taken in conjunction with the accompanying drawings, in which.

DETAILED DESCRIPTION

Figure 1:
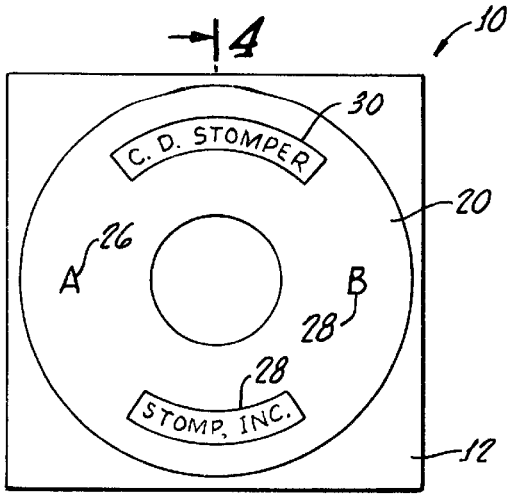
FIG. 1 is a plan view of the label system in accordance with the present invention generally showing a plastic film disposed on a release layer, the plastic film having indicia mark thereon which is erasable.

With reference to FIG. 1, there is shown an erasable and re-writable disc label system 10 in accordance with the present invention which is suitable for application to an optical disc (not shown), a suitable applicator (also not shown) such as the one described in U.S. patent application Ser. No. 08/928,241 now U.S. Pat. No. 5,951,819, manufactured by Stomp, Inc., may be used for precise positioning of the label 10 onto the optical disc.

Figure 2:
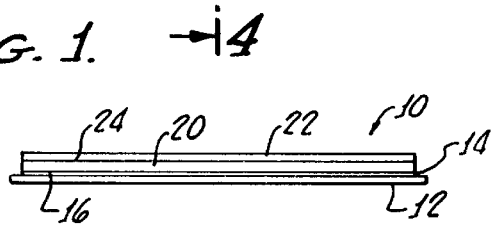
FIG. 2 is a side view of the label shown in FIG. 1 more clearly showing the plastic film release layer, with an adhesive therebetween and a coating as will be hereinafter described in greater detail.

More particularly, the label system 10 includes a release layer 12 formed from any suitable material as is well known in the art which may be coated with silicone to enhance a release of an adhesive layer 14, see FIG. 2, disposed on one side 16 of a plastic film 20. Thus, the adhesive layer 14 provides a means for enabling permanent application of the plastic film 20 to an optical disc without degradation of disc optic properties. In that regard the adhesive is preferably a water-based acrylic adhesive to prevent any physical or chemical reaction to the optical disc which may degrade or affect the disc optic properties.

A plastic film 20, which may be die cut from a sheet entirely overlaying the release layer 12, importantly must be made of a material which enables the plastic film 20 and the adhesive 14 to be removed from the release layer 12 while maintaining the plastic film initial shape, size and symmetry in order to prevent imbalancing of the optical disc upon application thereto. A suitable plastic material is a polyester having a thickness of between about 0.001 inches and about 0.003 inches. Preferably, the plastic film has a thickness of about 0.002 inches.

A coating 22 disposed on a second side 24 of the film 20 provides a means for enabling non-indelible marking thereon with a marker pen and subsequent erasure of the marking. The marker pen, not shown, may include a standard felt tip for placing indicia 26, 28 anywhere on the film 20 surface or in selected areas 30, 32.

Because the coating prevents the marker from penetrating or reacting with the surface of the film 20, it does not become indelible. Accordingly, the ink, or indicia 26, 28, can be easily removed from the film 20 by erasure with a common eraser, such as those sold by Pentel. The coating 22 enables the film 20 to be marked with a permanent marker, such as, for example, a Sharpie® Pen, which is resistant to accidental erasure and smudging thereof, but is still erasable with an eraser when desired. The coating 22 may be any suitable surface treatment such as Optiflex® available from Flexcon Co., Inc., Spencer, Mass. In effect, the coating 22 is a surface primer which allows various ink chemistries to adhere to the polymeric film while not becoming indelible.

It should be appreciated that the film 20 and adhesive 14 may be transparent for enabling visual perception therethrough of an existing label (not shown) on an optical disc (not shown) upon application of the plastic film 20 and adhesive 14 thereto. This in effect will convert an existing label into an erasable and re-writable disc label in accordance with the present invention.

Figure 3:
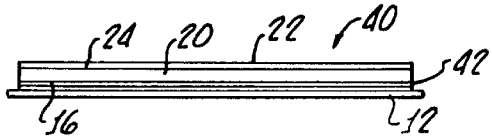
FIG. 3 is a side view of an alternative embodiment of the present invention in which the plastic film has indicia permanently marked on the side facing adhesive.

An alternative embodiment 40 of an erasable and re-writable disc label system in accordance with the present invention is shown in FIG. 3 in which common character references refer to identical or substantially identical components as hereinabove discussed in connection with the embodiment 10 of the present invention The embodiment 40 includes indelible indicia shown as a coating 42 on the one side 16 of the film between the film 20 and the adhesive 14. A transparent or translucent film 20 thus enables the visual perception of the indicia. This combination enables a permanent marking coloration design on the non-coated-side 16 of the film 20. The indicia 42 may in fact provide for indicated areas, zones or boxes, to facilitate marking of the label 40 with the marker pen as hereinabove described.

Figure 4:
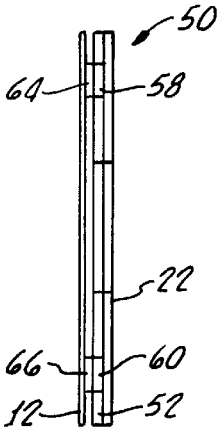
FIG. 4 is a cross sectional view of a label in which only selected areas of the label are applied to an optical disc.
Figure 5:
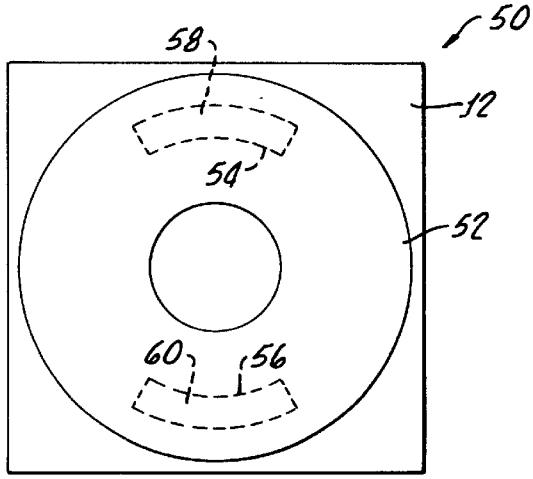
FIG. 5 is a plan view of the label shown in FIG. 4.

With reference to FIG. 4, another embodiment 50 of the present invention includes a film 52 having perforations 54, 56 as shown in dashed line in FIG. 5 to define selected areas 58, 60 which can be separated from the film 52 after application to an optical disc.

In this embodiment 50, acrylic adhesive 64, 66 is disposed only between the areas 58, 60 so that when applied to an optical disc only the areas 56, 60 will adhere to the disc in a symmetrical pattern defined by the film 52. The coating 22 may be applied over the entire film 52 or only over the selected areas 58, 60.

It is important to appreciate that the label system 50 thus provides for disposing symmetrically placed erasable and re-writable labels 58, 60 onto an optical disc, symmetrical placement being of utmost importance in order to maintain balance of the disc and prevent interference with data writing and reading from the disc.

Figure 6:
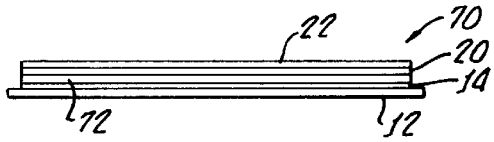
FIG. 6 shows a side view of yet another embodiment of the present invention which includes in addition to the plastic film coating adhesive and release layer, a substrate layer.

Yet another embodiment 70 in accordance with the present invention is shown in FIG. 6 in which the common character references refer to identical or substantially identical components of the label 10 as hereinabove described, The label system 70 includes a substrate 72 which may be printed or be a solid color for providing a background to the film 20. If the substrate 72 is imprinted, then preferably the film 20 is transparent or translucent. This arrangement enables various combinations of printing on the film 20 and substrate 72 to provide for different decorative effects.

Although there has been hereinabove described a specific arrangement of an erasable and rewritable disc label system for optical discs in accordance with the present invention for the purpose of illustrating the manner in which the invention may be used to advantage, it should be appreciated that the invention is not limited thereto. Accordingly, any and all modifications, variations or equivalent arrangements which may occur to those skilled in the art, should be considered to be within the scope of the present invention as defined in the appended claims.

What is claimed is:

1. An erasable and re-writable disc label system for optical discs, the label system comprising:

a release layer;

a plastic film disposed over said release layer and having one side of said plastic film releasably adhered to said release layer with acrylic adhesive means for enabling permanent application of said plastic film to an optical disc without degradation of disc optic properties, said plastic film being formed from a material enabling said plastic film and adhesive means to be removed from said release layer while maintaining plastic film initial shape, size and symmetry in order to prevent imbalancing of said optical disc upon application thereto; and coating means, disposed on a second side of said plastic film, for enabling non-indelible marking thereon with a marker pen and subsequent erasure of the marking.

2. The label system according to claim 1 wherein said plastic film and adhesive means are transparent for enabling visual perception therethrough of an existing label on said optical disc upon application of said plastic film and adhesive means thereonto.

3. The label system according to claim 1 further comprising indelible indicia on the one side of said plastic film and wherein said plastic film is transparent for enabling visual perception therethrough of the indicia.

4. The label system according to claim 1 wherein said coating means is disposed only in selected areas on the plastic film second side thereby enabling non-indelible and erasable marking on said selected areas.

5. The label system according to claim 4 wherein said selected areas are symmetrically arranged on the plastic film second side.

6. An erasable and re-writable disc label system for optical discs, the label system comprising:

a plastic film having an acrylic adhesive means, disposed on one side thereof, for enabling permanent application of said plastic film to an optical disc without degradation of disc optical properties, said plastic film being formed from a material enabling said plastic film and adhesive means to be applied to said optical disc while maintaining plastic film initial shape, size and symmetry in order to prevent imbalancing of said optical disc upon application thereto; and coating means, disposed on a second side of said plastic film, for enabling non-indelible marking thereon with a marker pen and subsequent erasure of the marking.

7. The label system according to claim 6 wherein said plastic film is transparent for enabling visual perception therethrough of an existing label on said optical disc upon application of said plastic film thereonto.

8. The label system according to claim 6 further comprising indelible indicia on the one side of said plastic film and wherein said plastic film is transparent for enabling visual perception therethrough of indicia.

9. The label system according to claim 1 wherein said coating means is disposed only in selected areas on the plastic film second side thereby enabling non-indelible and erasable marking on said selected areas.

10. The label system according to claim 9 wherein said selected areas are symmetrically arranged on the plastic second side.

11. An erasable and re-writable disc label system for optical discs, the label system comprising:

a release layer;

a plastic film disposed over said release layer and including perforation means for defining selected separable areas of said plastic film, one side of the selected areas being releasably adhered to said release layer with acrylic adhesive means for enabling permanent application of the plastic film selected areas to an optical disc without degradation of disc optical properties, the plastic film being symmetrically arranged in order to prevent imbalancing of said optical disc after application thereto, one side of non-selected area being separable from the selected areas by said perforation means after permanent application of the plastic film selected areas to said optical disc; and coating means, disposed on a second side of the plastic film selected areas, for enabling non-indelible marking thereof with a marker pen and subsequent erasure of the marking.

12. The label system according to claim 11 wherein said plastic film and adhesive means are transparent for enabling visual perception therethrough of an existing label on said optical disc upon application of the plastic film selected areas and adhesive means thereonto.

13. The label system according to claim 11 further comprising indelible indicia on the one side of the plastic film selected areas and wherein the plastic film selected areas are transparent for enabling visual perception therethrough of the indicia.

14. An erasable and re-writable disc label system for optical discs, the label system comprising:

a release layer;

an imprinted label disposed over said release layer and having one side of said imprinted layer releasably adhesive to said release layer with acrylic adhesive means for enabling permanent application of said imprinted label to an optical disc without degrading disc optic properties, said imprinted label being formed of a material enabling said imprinted label to be removed from said release layer while maintaining label initial shape, size and symmetry in order to prevent imbalancing of said optical disc upon application thereto;

a plastic film having one side adhered to another side of said imprinted layer, said plastic film being transparent for enabling visual perception therethrough of said imprinted label; and coating means, disposed on a second side of said plastic film, for enabling non-indelible marking thereon with a marker pen and subsequent erasure of the marking.

15. The label system according to claim 14 further comprising indelible indicia on the one side of said plastic film, the indicia being visually perceptive with the imprinted label through said plastic film.

16. The label system according to claim 14 wherein said coating means is disposed only in selected areas on the plastic film second side thereby enabling non-indelible and erasable marking on said selected area.

17. An erasable and re-writable disc label system for optical discs, the label system comprising;

a release layer;

a substrate label disposed over said release layer and hating one side of said substrate label releasably adhered to said release layer with acrylic adhesive means for enabling permanent application of said substrate layer to an optic disc without degrading disc optic properties, said substrate label being formed of a material enabling said substrate label to be removed from said release layer while maintaining label initial shape, size and symmetry in order to prevent imbalancing of said optical disc upon application thereto;

a plastic film having one side adhered to another side of said substrate layer; and coating means, disposed on a second side of said plastic film, for enabling non-indelible marking thereon with a marker pen and subsequent erasure of the marking.

18. The label system according to claim 17 further comprising indelible indicia on the one side of said plastic film and wherein said plastic film is transparent for enabling visual perception therethrough of the indicia.

19. The label system according to claim 17 wherein said coating means is disposed only in selected areas on the plastic film second side thereby enabling non-indelible and erasable marking on said selected area.

20. The label system according to any one of claims 1 to 19 wherein said plastic film comprises a polyester.

* * * * *